US006458008B1

(12) United States Patent
Hyneman

(10) Patent No.: US 6,458,008 B1
(45) Date of Patent: Oct. 1, 2002

(54) REMOTE CONTROL DEVICE WITH GYROSCOPIC STABILIZATION AND DIRECTIONAL CONTROL

(76) Inventor: Jamie Hyneman, 59 Newburg, San Francisco, CA (US) 94131

( * ) Notice: Subject to any disclaimer, the term of this patent is extended or adjusted under 35 U.S.C. 154(b) by 0 days.

(21) Appl. No.: 09/655,205

(22) Filed: Sep. 5, 2000

(51) Int. Cl.[7] ..... A63H 1/06
(52) U.S. Cl. ..... 446/259; 446/233; 446/454
(58) Field of Search ..... 446/233, 234, 446/235, 236, 256, 259, 266, 454

(56) References Cited

U.S. PATENT DOCUMENTS 3,628,285 A * 12/1971 Murakami ..... 446/233
4,272,916 A * 6/1981 Giordano et al. ..... 446/175
4,277,912 A * 7/1981 Hsien ..... 446/233
4,713,039 A * 12/1987 Wong ..... 446/233
5,413,518 A * 5/1995 Lin ..... 446/454
5,683,284 A * 11/1997 Christen ..... 446/233
5,823,845 A * 10/1998 O'Berrigan ..... 446/234
5,957,745 A * 9/1999 Johnson et al. ..... 446/234
6,042,449 A * 3/2000 Ishimoto ..... 446/234

* cited by examiner

*Primary Examiner*—Jacob K. Ackun
*Assistant Examiner*—Faye Francis
(74) *Attorney, Agent, or Firm*—Dergosits & Noah LLP

(57) ABSTRACT

A remote control device that utilizes a variable velocity gyroscope for stabilization as well as directional control. The gyroscope is mounted within a device shell and aligned vertically. When the device is stationary or traveling in a straight line, the rotational velocity of the gyroscope is constant. The direction of the moving device can be controlled by accelerating or decelerating the gyroscope.

7 Claims, 5 Drawing Sheets

REMOTE CONTROL DEVICE WITH GYROSCOPIC STABILIZATION AND DIRECTIONAL CONTROL

FIELD OF INVENTION

The present invention describes a mobile remote control device having gyroscope stabilization.

BACKGROUND

Gyroscopes are well known stabilizing devices which rotates a symmetric mass, usually a disc, about an axis. A spinning gyroscope resists changes in the orientation of rotational axis. Devices equipped with gyroscopes can balance upon a small area or point without falling over when the gyroscopic stabilizing force is greater than a rotational force tending to cause the device to fall over.

U.S. Pat. No. 5,823,845 describes a toy robot having movable appendages and an internal gyroscope that stabilizes the toy on a small support surface. The motions of these appendages create forces which would cause the toy robot to fall over without the gyroscopic stabilizing force. The stabilizing gyroscope disclosed in the '845 patent rotates an internal flywheel at substantially a constant velocity. The gyroscope is not used to control the direction or improve maneuverability of the device.

Remote control toys typically include cars, trucks, and boats which are typically miniature versions of full sized vehicles. These remote control toys are capable of very fast speeds and are prone to loss of control during fast maneuvers over uneven terrain and during fast directional or velocity changes. Remote control toys can flip over or move unpredictably when control is lost. The directional control of remote control toys is improved when the toys are more stable.

What is needed is a toy that incorporates an internal gyroscope to improve the device's directional control and ability to rapidly change directions of movement.

BRIEF DESCRIPTION OF THE DRAWINGS

The invention is herein described, by way of example only, with reference to embodiments of the present invention illustrated in the accompanying drawings, wherein.

SUMMARY OF THE INVENTION

Figure 1:
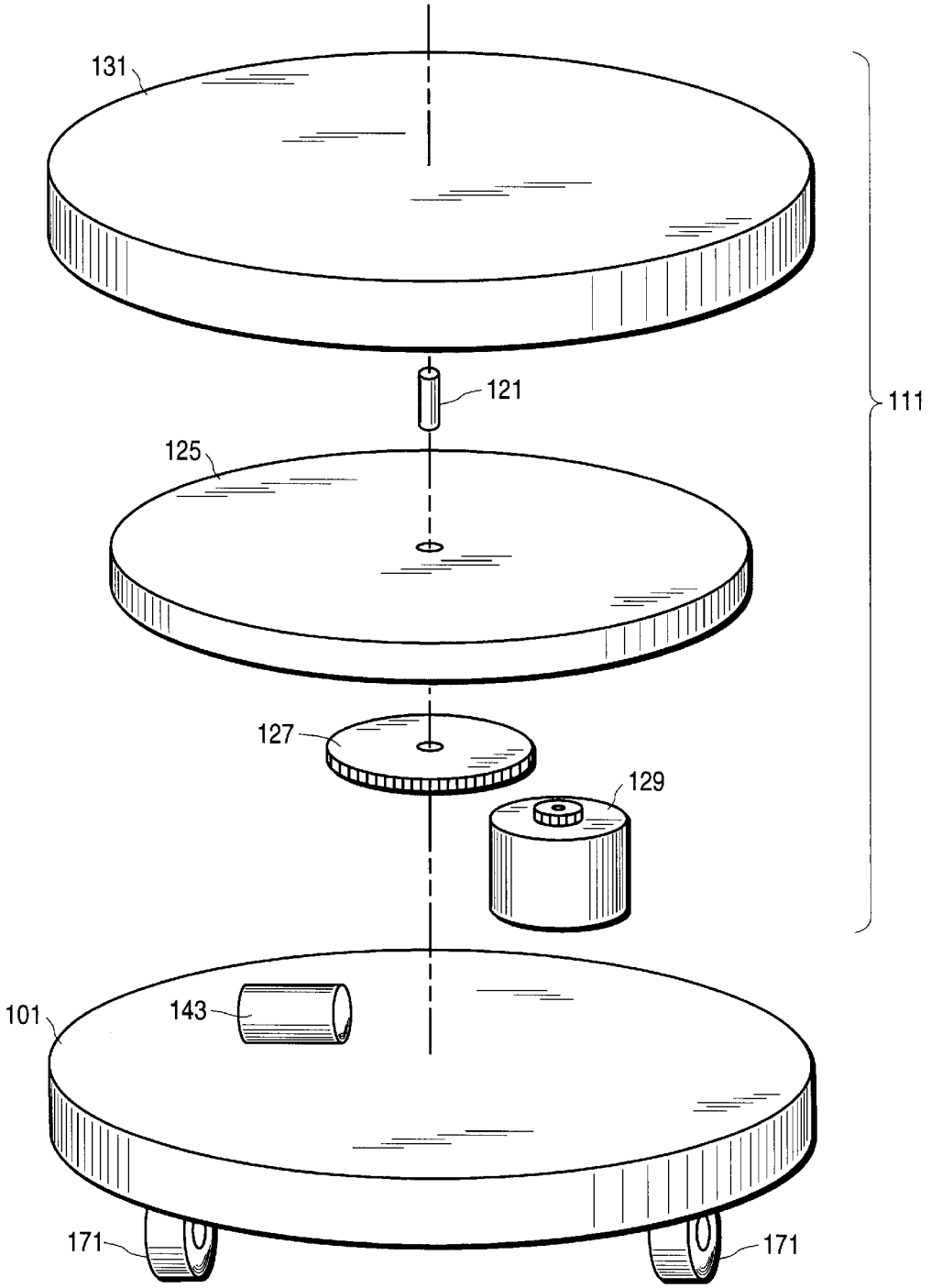
FIG. 1 is a gyroscope assembly mounted on a movable device.

The present invention is a highly mobile device having a variable velocity internal gyroscope and a drive mechanism mounted within a shell. The variable velocity gyroscope controls the direction of the device by accelerated or decelerated the rotational velocity of the gyroscope flywheel which rotates about a vertical axis. When the flywheel is accelerated or decelerated a rotational turning force about the vertical flywheel axis is applied to the device. The device responds to the turning force by changing its direction of travel. The drive mechanism is connected between the gyroscope and the shell and rotates the shell around an axis of rotation that is perpendicular to the flywheel's axis of rotation. By controlling the flywheel acceleration and deceleration and the drive mechanism velocity, the direction and velocity of the device are controlled.

In one embodiment, the drive mechanism is connected to the gyroscope and a horizontal axis of the shell. The gyroscopic force stabilizes the drive mechanism so that when the drive mechanism rotates the shell, the drive mechanism stays in a vertical orientation. The gyroscopic stabilizing force opposes rotation of the drive mechanism within the shell so that substantially the entire force of the drive mechanism is applied to the shell, improving the acceleration of the device. The stabilizing effect of the gyroscope similarly improves the turning capability of the device allowing the device to travel at high speeds through twists and turns. Again, the gyroscope maintains the drive mechanism's vertical orientation and opposes the rotational forces generated by the turning motion of the device.

In another embodiment, the drive mechanism is mounted under the gyroscope and supports the gyroscope within the shell. The drive mechanism rotates the shell about the gyroscope by rotating the drive wheel that rests upon the internal shell surface. The direction of the device can be controlled by accelerating or decelerating the gyroscope flywheel and the velocity of the device is controlled by the drive wheel velocity. Bearings are attached to the gyroscope and roll with low friction against the internal shell surface. The bearings center the gyroscope and drive mechanism within the shell. Again, the gyroscopic force stabilizes and maintains the vertical orientation of the drive mechanism for improved acceleration and maneuverability through turns.

In another embodiment, a drive mechanism having two drive wheels is mounted under the gyroscope and supports the gyroscope within the shell. The drive wheels are preferably mounted in parallel and on opposite sides of the centerline of the device. The velocity of the device is controlled by the velocity of the drive wheels and the direction of the device is controlled by the difference in velocity of the two drive wheels. If one drive wheel rotates at a slower velocity than the other drive wheel, the device will turn towards the slower rotating drive wheel. Bearings are used to center the gyroscope and drive mechanism within the shell.

DETAILED DESCRIPTION

The present invention is a movable device having an internal gyroscope which improves the acceleration and maneuverability of the remote control device. The gyroscopic stabilizing force maintains the vertical orientation of the drive mechanism and counteracts any rotational force due to rapid movement of the device during acceleration or high speed turning.

Referring to FIG. 1, a remote control device 101 is illustrated with an incorporated gyroscope 111. A flywheel motor 129 drives a flywheel drive gear 127 which rotates a flywheel 125 about a flywheel shaft 121. The flywheel motor 129 may be electrically powered by batteries 143. Alternatively, the flywheel motor 129 may be a gas powered engine or any other type of rotational drive mechanism. The flywheel 125 is mounted in a flywheel housing 131 that may completely surround the moving components of the gyroscope 111 to prevent the moving components from coming into contact with other objects. The velocity of the flywheel motor 129 may be remotely controlled by a radio frequency transmitter and receiver (not shown). The rotational axis of the flywheel 125 is substantially perpendicular to the plane upon which the remote control device 101 travels so that as the remote control device 101 changes directions the vertical rotational axis of the flywheel 125 does not change. The rotating flywheel 125 improves the stability of the remote control device 101 by opposing rotational forces which act upon the vertical orientation of the remote control device 101.

The direction of the device 101 may be controlled by the flywheel 125. When the flywheel 125 rotates at a constant velocity and the remote control device 101 travels in a straight path, however if the rotational velocity of the flywheel 125 is varied the direction of the remote control device 101 is changed. For example, if the flywheel 125 is rotating in a clockwise direction, accelerating the flywheel 125 will cause the device 101 to turn left. The rotational velocity of the flywheel 125 is accelerated by accelerating the flywheel motor 129. When the flywheel 125 accelerated, an equal and opposite counter clockwise force acts upon the device 102 and causes the device 101 to turn left. The acceleration force is equal to the flywheel 125 mass times the flywheel 125 acceleration (F=MA). Conversely, a counter clockwise deceleration force applied to the flywheel 125 produces an equal and opposite clockwise force which causes the device 101 to turn right. If the flywheel 125 is rotating counter clockwise, flywheel 125 acceleration will cause the device 101 to turn right and flywheel 125 deceleration will cause the device 102 to turn left. Thus, by controlling the acceleration and deceleration of the flywheel 125, the direction of the device 101 can be controlled. In an alternative embodiment, the direction of the device 101 can be controlled by changing the direction of wheels 171 on the bottom of the device 101.

Figure 2:
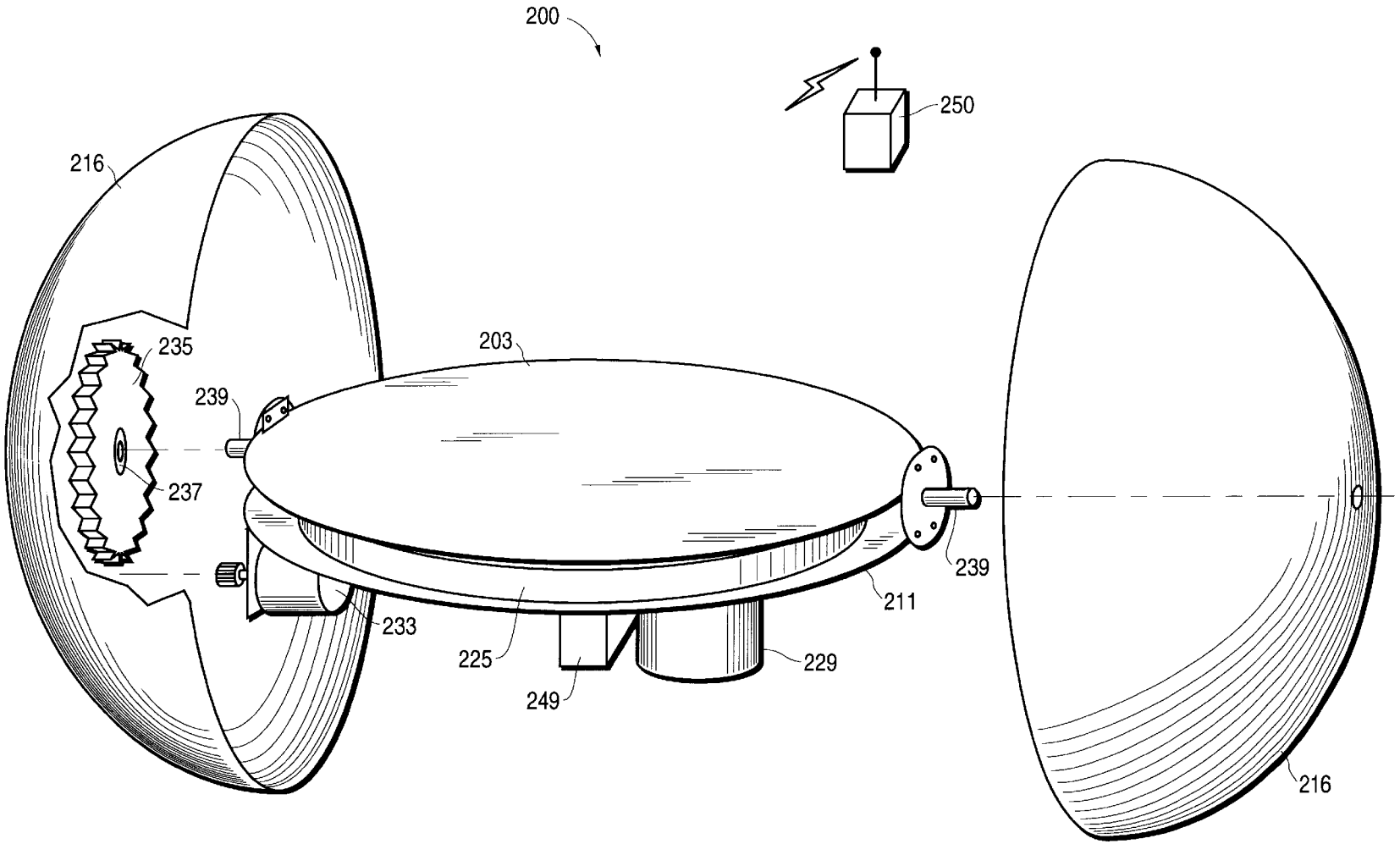
FIG. 2 is an exploded view of the shell and internal assembly of the device.

FIG. 2, illustrates an exploded view of another embodiment of the device 200 having internal assembly 203 which is supported within a two piece shell 216 by two axles 239. The internal assembly 203 includes: a drive motor 233, a flywheel motor 229, a flywheel 225 and a gyroscope 211. Although a spherically shaped two piece shell 216 is illustrated, the shell 216 may have any three dimensional shape. The drive motor 233 controls the velocity of the device 200 and the gyroscope 211 controls the direction of the device 200.

The remote control device 200 moves when the drive motor 233 applies a rotational drive force to a drive gear 235 mounted about the axis of rotation of the shell 216. The drive force causes the shell 216 to rotate about the gyroscopically stabilized internal assembly 203. The velocity of the device 200 is directly proportional to the rotational velocity of the drive motor 233. The drive motor 233 and the flywheel motor 229 may be remotely controlled by a receiver 249 which receives control signals from a transmitter 250.

The gyroscope 211 improves the acceleration of the device 200 because the gyroscope 211 keeps the internal assembly 203 level even while the drive motor 233 applies a rotational force to the shell 216. Because the internal assembly 203 remains horizontally stable, a higher drive force can be applied to the shell 216. Without the stabilizing effect of the gyroscope 211, the internal assembly 203 would rotate within the shell 216 limiting the rotational drive force that can be applied to the shell 216. As discussed, the speed and direction of the device 200 are controlled by coordinating the acceleration and deceleration of the flywheel 225 and the velocity of the drive motor 233.

Figure 3:
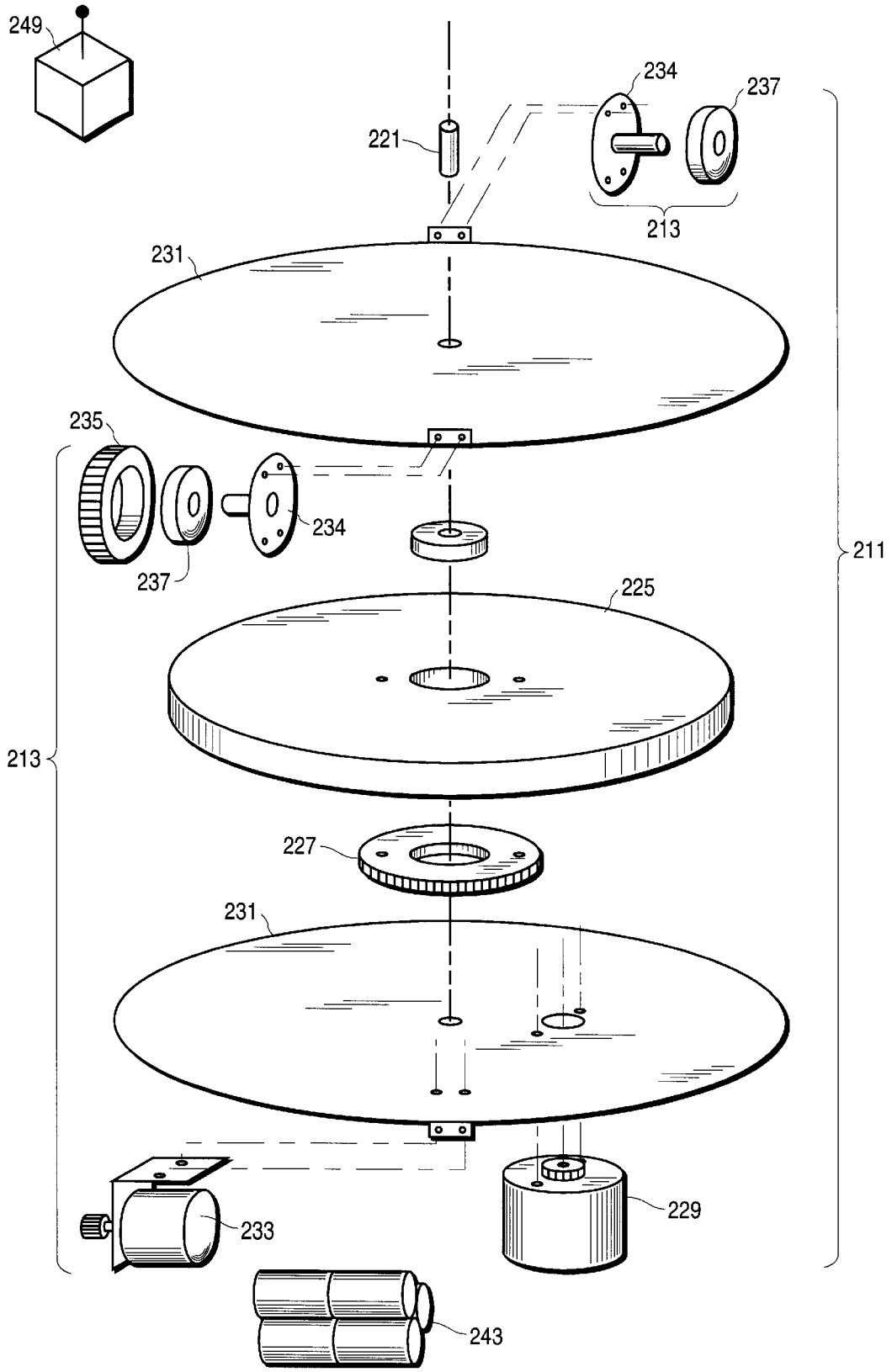
FIG. 3 is an exploded view of the internal assembly of the device.

The internal assembly 203 is illustrated in more detail in FIG. 3. The internal assembly 203 has gyroscope 211 components and drive components 213. The gyroscope 211 includes a flywheel 225, a flywheel shaft 221, a flywheel motor 229, a flywheel drive gear 227 and a housing 231. The gyroscope 211 components work together to rotate the flywheel 225 as described with reference to FIG. 1. The drive components 213 include a drive motor 233 rotates a drive gear 235 which is connected to the shell (not shown). The drive motor 233 is mounted on the housing 231 and stabilized by the gyroscope 211. The flywheel motor 227 and the drive motor 233 are powered by batteries 243 which are also mounted to the flywheel housing 231. As discussed, a gas motor or any other rotational mechanism may be used instead of the flywheel motor 229 or the drive motor 233. The internal assembly 203 is supported by axles 239 which rotate in bearings 237 mounted on the shell.

In an embodiment, the movable device is remotely controlled by a radio frequency transmitter (not shown) which transmits signals to a radio frequency receiver 249. The receiver 249 is mounted on the internal assembly 203 and controls the velocities of the fly wheel motor 229 and the drive motor 233. An operator can remotely control the speed of the movable device by transmitting drive motor 233 control signals from the radio frequency transmitter to the receiver 249 which controls the drive motor 233 velocity. Similarly, the operator can remotely control the direction of the movable device by transmitting a flywheel 225 acceleration or deceleration signal to the receiver 249 which controls the flywheel motor 229 velocity.

In another embodiment, the inventive device may be large enough for the operator to drive as an all terrain vehicle. The shell may have a diameter of about 10 feet or larger with sufficient volume for the operator and passengers to sit under the internal assembly and flywheel. From the driver's seat the operator controls the rotational velocity of the gyroscope and the velocity of the shell. The shell may be a spherical frame work of flexible steel rods that allows the operator to see where she is driving and provides ventilation. The flexible steel rods may function as a suspension system for the internal assembly by flexing to absorb the impact as the device travels over rough terrain. To further improve passenger comfort, a suspension system may be mounted between the internal assembly.

Note that if the device is always turning in the same direction, the rotational velocity of the flywheel may continue to either accelerate or decelerate. Eventually the flywheel will either stop or rotate at the maximum velocity of the flywheel motor. In order to maintain the flywheel velocity with a proper working velocity, the flywheel motor may be configured to rapidly accelerate or decelerate the flywheel when changing the device direction and slowly accelerate or decelerate the flywheel while the device is moving in a straight line. If the acceleration or deceleration of the flywheel is gradual, the turning force upon the device may not substantially effect the direction of the device. Using this process, the flywheel will always operate within the working velocity range of the flywheel motor.

Figure 4:
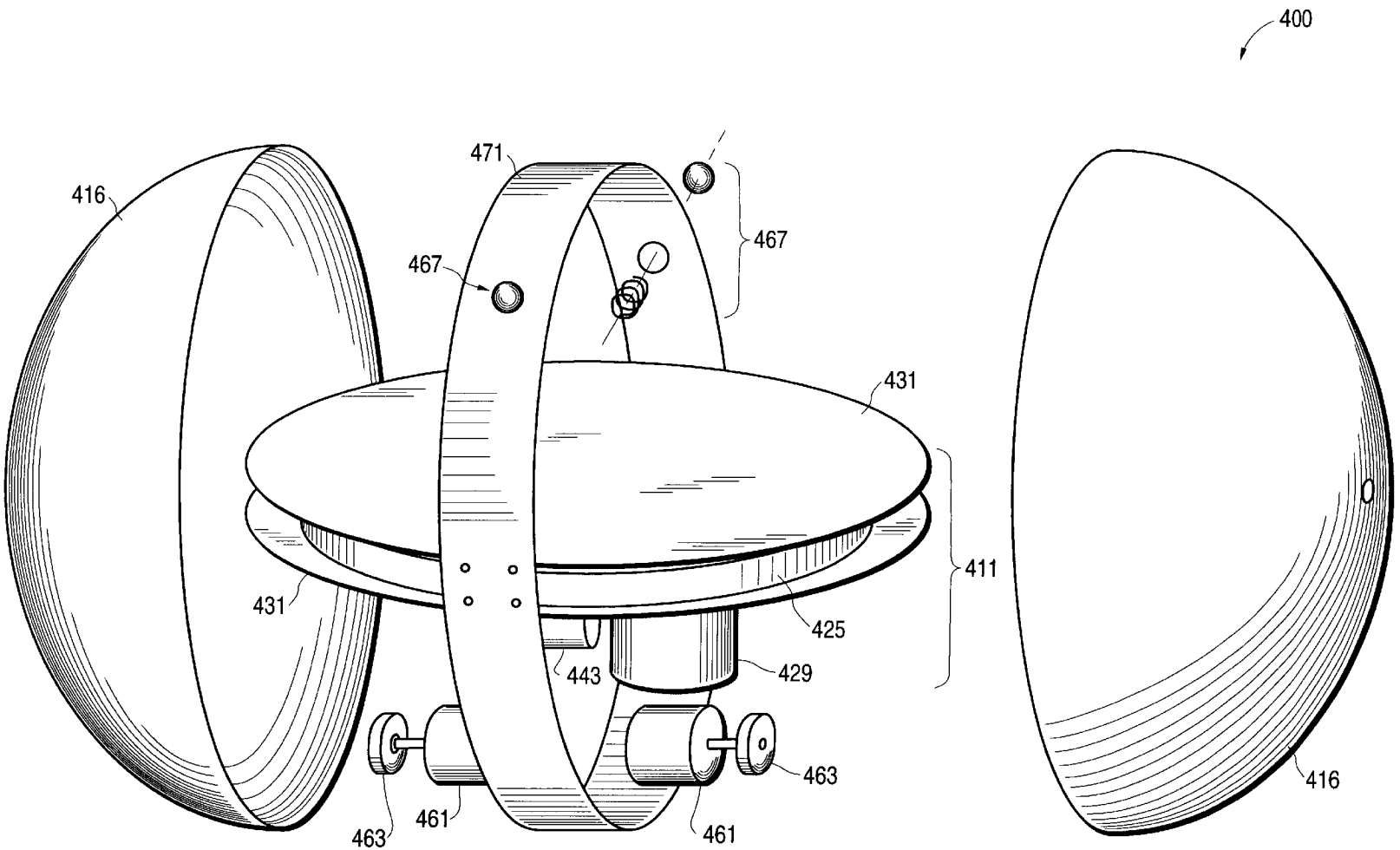
FIG. 4 is an embodiment of the internal assembly supported by two wheels.

Referring to FIG. 4, in an alternate embodiment the movable device 400 has an internal assembly 403 positioned within but not attached to a hollow shell 416. Two drive motors 461 are connected to drive wheels 463 that support the internal assembly 471 within the hollow shell 416. The drive motors 461 can rotate in forward or reverse directions and are connected to the drive wheels 463. The drive wheels 463 are preferably mounted parallel to each other and on opposite sides of a centerline of the internal assembly 471.

The gyroscope 411 includes: a flywheel 425, a flywheel drive gear, a flywheel motor 429 and a flywheel housing 431. The gyroscope 411 components work together to rotate the flywheel 425 as described with reference to FIG. 1. The flywheel motor 429 and the drive motors 461 are powered by batteries 443 which are also mounted to the flywheel housing 431. The gyroscope 411 acts to stabilize the internal assembly 411 by counteracting rotation away from the vertical axis of rotation of the flywheel 425 improving the acceleration and maneuverability of the device 400.

Low friction bearings 467 are mounted on the internal assembly to keep the internal assembly 471 centered within the shell 416. The bearings 467 slide or roll against the inner surface of the shell 416 and are necessary to prevent the internal assembly 471 from contacting the shell 416 during operation. The bearings 467 reduce the rotational friction of the internal assembly 471 moving within the shell 416. The bearings 467 may be freely rotating wheels, air bearings, roller bearings, needle bearings, ball bearings, low friction sliding surfaces or any other type of bearing surface. In the preferred embodiment, at least two spring loaded roller ball bearings 467 are mounted symmetrically along the centerline of the internal assembly 471 in proximity to the upper hemisphere of inner surface of the shell 416.

As discussed in other embodiments, the direction of the device 400 is controlled by accelerating and decelerating the flywheel 425. When the device 400 is stationary or travelling in a straight path, the flywheel 425 rotates at a constant velocity. The flywheel 425 is accelerated or decelerated to turn the device 400. By coordinating the acceleration and deceleration of the flywheel 425 and the velocities of the drive motors 463, the direction of the device 400 can be controlled.

In another embodiment, the flywheel 425 rotates at a constant velocity and the direction of the device 400 is controlled by the relative velocities of the drive wheels 463. When both of the drive wheels 463 are rotating at the same speed the device 400 moves in a straight line. When one of the drive wheels 463 rotates faster than the other drive wheel 463, the device 400 turns towards the slower rotating drive wheel 463. The drive motors 461 are controlled by the radio frequency receiver allowing an operator to remotely control the speed and direction of the device 400.

Figure 5:
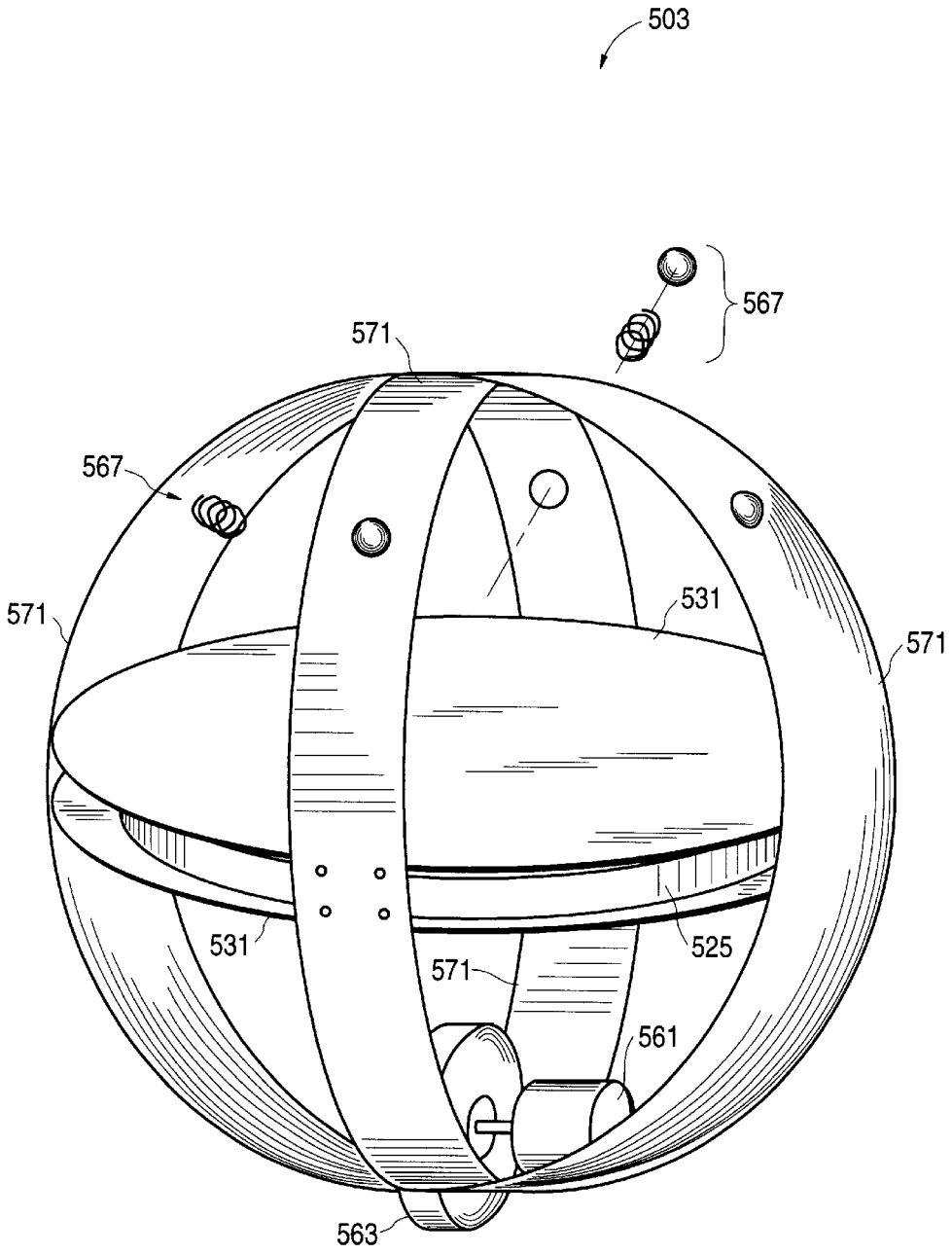
FIG. 5 is an embodiment of the internal assembly supported by a single wheel.

Referring to FIG. 5, in another embodiment, a single drive wheel 563 connected to a drive motor 561 is mounted on the bottom of the internal assembly 503 and supports the internal assembly 503 within the shell. The device travels in the direction of the drive wheel 563. Preferably, at least three spring loaded roller ball bearings 567 are mounted are mounted in close proximity to the internal surface of the shell to prevent the internal assembly 503 from contacting the shell. The direction of the device 400 is controlled by accelerating or decelerating the rotational velocity of the flywheel 525 as described in the other embodiments.

The device has been described as being controlled with radio frequency remote control units. In alternative embodiments, the drive motor(s) and flywheel motor may be controlled by signals transmitted through wires to a remote control unit. A rotational electrical coupling may be used to prevent the wires from twisting and interfering with the operation of the device. In another embodiment, the device may have a microprocessor and a set of control instructions in memory for controlling the drive motor(s) and flywheel motor. The device may also have sensors which detect contact with other objects, the type of terrain that the device is travelling over, or any other type of detectable information. These sensor(s) may be in communication with the microprocessor so that the device can respond to these operating conditions. For example, the device may detect contact with an object and be programmed to respond by stopping or reversing direction. The device may have other types of sensors which convey information to the microprocessor.

In an embodiment input and output devices may be mounted within the shell. For example, the shell may be transparent and a display output may be mounted within the shell which allows observers to view displayed information. The display may be a picture, poster or a screen which is maintained in the upright orientation by the gyroscopically stabilized internal assembly. Recorded information may be transmitted to the internal screen by a video playback mechanism for displaying information such as a video tape, video disk or computer. A wireless receiver may be used for displaying broadcast information. In these embodiments, people will be able to view the display by looking through the transparent shell of the remote control ball device. An audio system may also be incorporated to allow audio messages to be transmitted from the remote control ball device. The incorporation of audio and visual outputs may allow the remote control ball device to be used as an advertisement system.

In an embodiment, input devices may also be incorporated into the remote control ball. Input devices may include: microphones, temperature probes, cameras, spectrum analyzers, and any other type of input device. A camera may be mounted in a remote control ball device having a transparent shell. The camera will always be upright because of the gyroscopically stabilized internal assembly. Similarly, the camera can be configured to always be facing in the same direction relative to the forward movement of the remote control ball. For example a camera mounted on the internal assembly facing forward will facing forward because the internal assembly is always in line with the direction of travel. By incorporating the input devices, the remote control ball can be used as an information gathering or communications system in remote or hazardous areas.

In all embodiments, the gyroscope stabilizes the internal assembly and prevents pendulum like reverberation within the shell. If the controllable devices were operated without a gyroscope, the internal assemblies may rotate or completely flip within the shell during rapid acceleration, deceleration or directional changes. The gyroscope stabilizes the device such that it is capable of precisely starting, stopping and turning. To further improve the maneuverability of the device, the outer surface of the shell may have a high coefficient of friction that improves the traction and allows faster acceleration, deceleration and directional changes. The coefficient of friction of the outer surface can be increased by adding a texture to the outer surface and/or utilizing a material on the outer surface that has a high coefficient of friction.

During operation of the inventive device, the gyroscope rotates at a velocity that provides the desired stability for the expected operating conditions of the device. Higher flywheel velocity provides higher stability which may be required for rough terrain or high performance. A lower flywheel velocity requires less power and provides lower stability which may be sufficient for operating the device on smooth surfaces. Similarly, the mass of the flywheel relative the device will affect the stabilizing effect of the gyroscope. A more massive flywheel produces a higher stabilizing force for a given rotational velocity and requires less acceleration and deceleration to turn and control the direction of the device. In an embodiment, the steady state rotational speed of the gyroscope is variable to accommodate variable stability requirements of the remote control device.

The remote control devices, motors, servos, batteries, receivers, and speed controllers used to control the devices may be the same as those commonly available for use with radio frequency remote control toys. Although the illustrated embodiments show motors connected to gears, flywheels, shells and drive wheels, it is also possible to incorporate a clutch mechanism to the flywheel and drive mechanisms. The clutch mechanism allows the flywheel motor to operate intermittently. When the flywheel rotates below the desired velocity, additional power can be applied by the flywheel motor and when the flywheel is rotating at the desired speed the flywheel motor can be disengaged to conserve power. The speed of the drive and freewheel motors may be controlled by servo speed controller, a throttle, a clutch, a velocity governor or any other suitable speed control mechanism.

In the preferred embodiment, the gyroscope is mounted as low as possible to keep the center of mass low and further improve the stability of the device during rapid acceleration, deceleration or directional changes. Batteries, motors and other components are also preferably mounted as low as possible in the device to lower the center of mass. The flywheel mass is preferably sufficient to properly stabilize and control the toy's movement given the rotational velocity limitations of the flywheel motor and power source. Higher flywheel mass requires more power to move resulting in less efficient operating.

In the foregoing, a controllable device having gyroscopic stabilization has been described. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A mobile device comprising:

a gyroscope having a flywheel driven by a flywheel motor;

a shell having an interior space;

a drive motor; and an internal housing upon which the gyroscope and drive motor are mounted; wherein the internal housing is mounted in the interior space of the shell and the drive motor rotates the shell around the internal housing and the gyroscope is accelerated or decelerated to change the direction of the controllable device.

2. The mobile device of claim 1, wherein the rotational velocity of the flywheel motor and the rotational velocity of the drive motor are controlled by a remote control unit.

3. The mobile device of claim 1, wherein the rotational velocity of the flywheel motor and the drive motor are controlled by controller is a programmable microprocessor.

4. The mobile device of claim 3, further comprising: two bearings mounted between the shell and the internal housing.

5. The mobile device of claim 4, wherein the two bear are mounted on symmetrically opposite sides of the shell.

6. The mobile device of claim 1, wherein the exterior surface of the shell is substantially spherical in shape.

7. The mobile device of claim 1, further comprising a battery mounted on the internal housing.

* * * * *